US007004555B2

(12) United States Patent
Sugahara

(10) Patent No.: US 7,004,555 B2
(45) Date of Patent: Feb. 28, 2006

(54) APPARATUS FOR EJECTING VERY SMALL DROPLETS

(75) Inventor: Hiroto Sugahara, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 198 days.

(21) Appl. No.: 10/654,917

(22) Filed: Sep. 5, 2003

(65) Prior Publication Data

US 2004/0046825 A1 Mar. 11, 2004

(30) Foreign Application Priority Data

Sep. 10, 2002 (JP) ..... 2002-263656

(51) Int. Cl.
*B41J 29/38* (2006.01)

(52) U.S. Cl. ..... 347/9; 347/10; 347/11

(58) Field of Classification Search ..... 347/9, 347/12, 20, 40, 21, 44, 47, 54, 68, 74, 75, 347/90

See application file for complete search history.

(56) References Cited

U.S. PATENT DOCUMENTS

| | | | | |
|---|---|---|---|---|
| 6,086,196 | A | 7/2000 | Ando et al. | |
| 6,164,748 | A * | 12/2000 | Taneya et al. | 347/15 |
| 6,364,470 | B1 | 4/2002 | Cabal et al. | |
| 6,409,318 | B1 * | 6/2002 | Clark | 347/65 |
| 2002/0005871 | A1 * | 1/2002 | Horio et al. | 347/11 |

FOREIGN PATENT DOCUMENTS

| | | | |
|---|---|---|---|
| DE | 3501905 | A1 | 12/1985 |
| EP | 0 895 864 | A2 | 2/1999 |
| EP | 1 197 335 | A1 | 4/2002 |
| EP | 1197335 | A1 * | 4/2002 |
| JP | A 7-285222 | | 10/1995 |
| JP | 09141901 | | 6/1997 |

* cited by examiner

*Primary Examiner*—Lamson Nguyen
(74) *Attorney, Agent, or Firm*—Oliff & Berridge, PLC

(57) ABSTRACT

An apparatus for ejecting very small droplets according to the present invention comprises a first ink ejector and a second ink ejector. The first ink ejector is controlled to eject a main droplet and a satellite droplet in accordance with one ink ejection signal such that the main droplet collides with an ink droplet ejected from the second ink ejector. A trajectory of a united droplet, formed by the collision of both droplets, is different from a trajectory of the main droplet, and the united droplet flies toward an in catcher. Only the satellite droplet having very small volume lands on a paper.

20 Claims, 7 Drawing Sheets

APPARATUS FOR EJECTING VERY SMALL DROPLETS

BACKGROUND OF THE INVENTION

1. Field of the Invention

The present invention relates to an apparatus such as an ink-jet printer capable of ejecting very small droplets.

2. Description of Related Art

In ink-jet printers, it is desired that each ink droplet to be ejected from a printing head is as small as possible in order to improve print quality. From this viewpoint, an existing ink-jet printing head can eject small ink droplets of about 2 pl by, for example, devising a control pulse waveform for an actuator to apply ejection energy to ink, or decreasing the diameter of each nozzle.

In recent years, however, it is required to eject very small ink droplets of less than 2 pl to realize higher-quality, higher-resolution print. By the above-described technique of devising a control pulse waveform or decreasing the diameter of each nozzle, however, it is difficult to further decrease the size of each ink droplet.

Other than the above-described techniques, there is known a technique to regulate a control pulse waveform and, at the same time, to regulate a distance between the nozzle and a print medium such that a main dot (a main ink droplet) and a satellite dot (a satellite ink droplet), both of which are ejected through a nozzle in accordance with one pressure variation, may have substantially the same weight and such that landing positions of those two ink droplets may be different from each other. (see Japanese Patent Application Laid-open No. 7-285222). By this technique, the size of the main ink droplet can be decreased, besides the satellite ink droplet can be increased in size and thus this can be a dot independent of the main dot.

However, for printing an image at a very high resolution having, e.g., photographic quality, it is required to eject ink droplets each smaller than those obtained by the above-described technique. In addition, other than the requirement of ejecting very small ink droplets, there may be a requirement for an ink-jet printer to eject very small droplets of conductive paste and thereby print a very fine electric circuit on a substrate.

SUMMARY OF THE INVENTION

An object of the present invention is to provide an apparatus capable of ejecting very small droplets.

According to an aspect of the present invention, there is provided an apparatus for ejecting very small droplets to form dots on a print medium. The apparatus comprises: a first droplet ejector capable of ejecting a main droplet in a first trajectory and a satellite droplet smaller in volume than the main droplet, the satellite droplet being ejected together with the main droplet; a second droplet ejector capable of ejecting a droplet in a second trajectory intersecting the first trajectory; and a control unit for controlling the first and second droplet ejectors so that the main droplet and the droplet ejected from the second droplet ejector collide and unite with each other and a united droplet flies in a trajectory different from the first trajectory of the main droplet, and the satellite droplet lands on the print medium.

According to the invention, the main droplet ejected from the first droplet ejector and the droplet ejected from the second droplet ejector collide with each other to be united and the united droplet flies in a trajectory different from the trajectory of the main droplet. As a result, only the very small satellite droplet having a volume of, e.g., 0.002 to 0.5 pl, ejected from the first droplet ejector, can reach a print medium. Thus, a very high-resolution image can be printed by ejecting droplets of ink, a very fine electric circuit pattern can be printed by ejecting droplets of a conductive paste, or a high-resolution display device such as an organic electroluminescence display (OELD) by ejecting droplets of an organic luminescent material.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
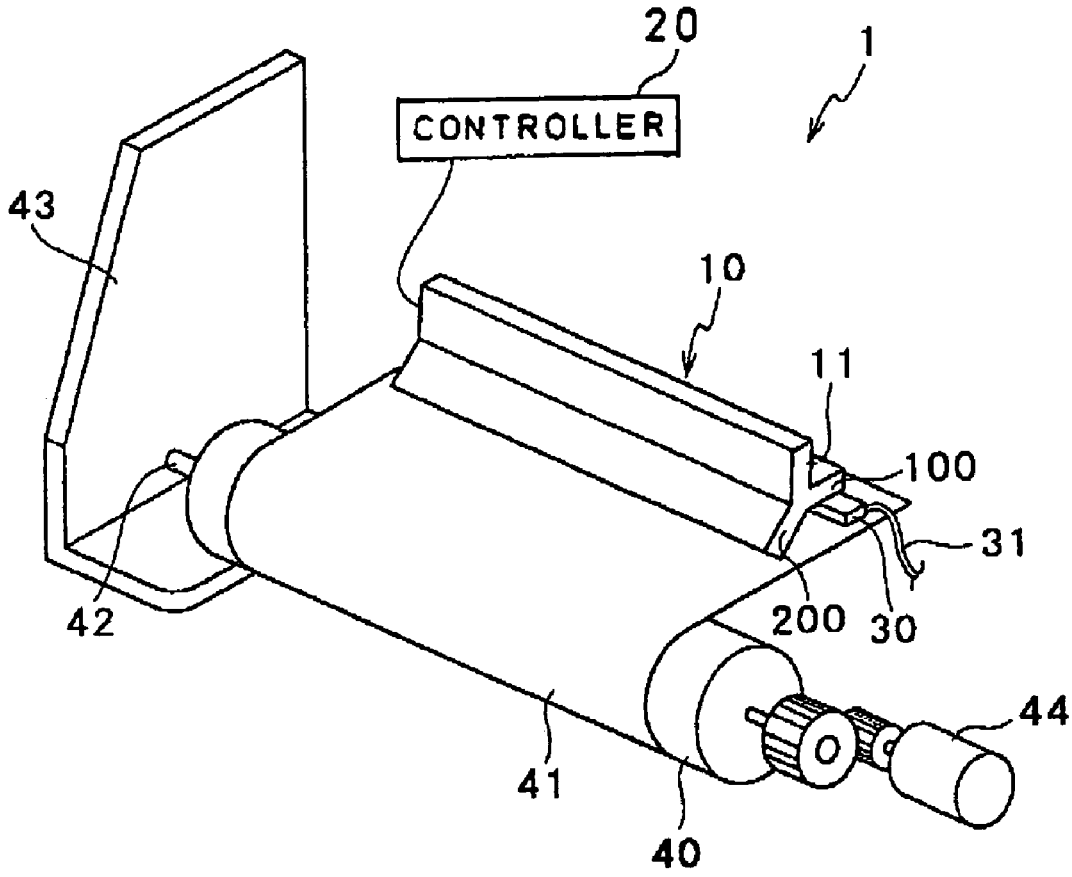
FIG. 1 is a perspective view of a principal part of an ink-jet printer according to an embodiment of the present invention.

Referring to FIG. 1, an ink-jet printer 1 according to an embodiment of the present invention includes therein a platen roller 40 for running a paper 41 as a print medium, an ink-jet head 10 for ejecting ink onto the paper 41 being run by the platen roller 40, and a controller 20 for controlling the operation of each part of the ink-jet printer 1, such as the ink-jet head 10.

The platen roller 40 is supported on a shaft 42 attached to a frame 43 so as to be rotatable. The shaft 42 is driven by an electric motor 44 to rotate together with the platen roller 40. The paper 41 is fed from a non-illustrated paper feed cassette provided in one side portion of the ink-jet printer 1. The paper 41 is then run by the platen roller 40 at a constant speed. After printing is performed on the paper 41 with ink ejected from the ink-jet head 10, the paper 41 is discharged from the ink-jet printer 1.

In FIG. 1 omitted is illustration of the systems for feeding and discharging the paper 41. The ink-jet printer 1 of FIG. 1 includes therein only one ink-jet head 10 because it is a monochrome printer. In the case of a color printer, at least four ink-jet heads 10 for yellow, magenta, cyan, and black are provided in parallel.

As illustrated in FIG. 1, the ink-jet head 10 of this embodiment is a line head extending perpendicularly to the running direction of the paper 41. The ink-jet head 10 is fixed to the frame 43.

The ink-jet head 10 includes two flat ink ejectors, i.e., a first ink ejector 100 and a second ink ejector, 200, each extending along the length of the ink-jet head 10. The ink ejectors 100 and 200 are joined to each other at their respective one ends in width to form an angle of 135 degrees with each other (see FIG. 3). From the joint portion between the ink ejectors 100 and 200, a base portion 11 extends perpendicularly to the first ink ejector 100.

The first ink ejector 100 has an ink ejection face where a large number of nozzles 109 (see FIG. 2) are arranged in a row along the length of the first ink ejector 100. The ink ejection face is disposed so as to be parallel to the upper face of the paper 41 being run by the platen roller 40. Therefore, each ink droplet ejected through each nozzle 109 of the first ink ejector 100 under the control of the controller 20, flies in a trajectory substantially perpendicular to the paper 41. As will be described later, the controller 20 controls the first ink ejector 100 so that each nozzle 109 can eject a main droplet having a relatively large diameter of, e.g., about 4 to 25 $\mu$m, and a satellite droplet smaller in volume than the main droplet, for example, having a diameter of about 1.6 to 10 $\mu$m, in accordance with one ink ejection signal.

When a diameter of the nozzle is nearly 20 $\mu$m, a main droplet has a diameter of 25 $\mu$m and a volume of 8 pl, and a satellite droplet has a diameter of 10 $\mu$m and a volume of 0.5 pl. When a diameter of the nozzle is nearly 3.5 $\mu$m, a main droplet has a diameter of 4 $\mu$m and a volume of 0.03 pl, and a satellite droplet has a diameter of 1.6 $\mu$m and a volume of 0.002 pl. In these cases, an ejection speed of the main droplet is about 9 m/sec, and an ejection speed of the satellite droplet is about 5.5 m/sec.

The second ink ejector 200 has an ink ejection face where a large number of nozzles 209 (see FIG. 3) are arranged in a row along the length of the second ink ejector 200. The ink ejection face of the second ink ejector 200 forms an angle of 45 degrees with the upper face of the paper 41 being run by the platen roller 40. The trajectory of each ink droplet ejected from the second ink ejector 200 at an adequate ejection speed intersects the trajectory of a main droplet ejected from the first ink ejector 100, before the ink droplet ejected from the second ink ejector 200 reaches the upper face of the paper 41. Therefore, when the ejection speed and timing of the ink droplet to be ejected from the second ink ejector 200 are adequately controlled by the controller 20, the ink droplet ejected from the second ink ejector 200 can collide with the main droplet ejected from the first ink ejector 100.

An axis of the nozzle 109 (an ejecting direction of droplets from the nozzle 109) in the first ink ejector 100 and an axis of the nozzle 209 (an ejecting direction of droplets from the nozzle 209) in the second ink ejector 200 are disposed so as to form an angle with each other. Moreover, the axis of the nozzle 109 in the first ink ejector 100 is perpendicular to the paper 41, while the axis of the nozzle 209 in the second ink ejector 200 is tilted with respect to the paper 41.

The controller 20 controls the operations of parts of the ink-jet printer 1, such as the electric motor 44 and the ink-jet head 10. Particularly in this embodiment, the controller 20 controls the ink ejection timings and speeds of the respective first and second ink ejectors 100 and 200. By this control, in the case of the first ink ejector 100, a main droplet and then a satellite droplet smaller in volume than the main droplet are ejected in accordance with one ink ejection signal, which means a drive pulse corresponding to one dot on the paper 41. Contrastingly in the case of the second ink ejector 200, only one ink droplet is ejected in accordance with one ink ejection signal. Further, the main droplet ejected from the first ink ejector 100 and the ink droplet ejected from the second ink ejector 100 collide with each other to be united and the united ink droplet flies in a trajectory different from the trajectory of the main droplet. The ink ejection speed can be controlled by controlling at least one of the pulse height, the number of pulses, the pulse width of the ink ejection signal.

For making the first ink ejector 100 eject a main droplet and a satellite droplet in accordance with one ink ejection signal, in many cases, the ink ejection speed may be set within an adequate range of relatively high values. An example of the range may be from about 5 m/sec to about 15 m/sec. For making the second ink ejector 200 eject only one ink droplet in accordance with one ink ejection signal, in many cases, the ink ejection speed may be set within an adequate range of relatively low values. An example of the range may be about 5 m/sec and less. However, an adequate range of the ink ejection speed varies depending on physical properties of ejected liquid.

In the ink-jet printer 1 of this embodiment, as illustrated in FIG. 1 or FIGS. 4A to 4D, an ink catcher 30 is provided at a position somewhat deviated from the trajectories of main droplets ejected from the first ink ejector 100, so as to intersect the trajectories of united ink droplets before each united ink droplet reaches the upper face of the paper 41. The upper face of the ink catcher 30 is made of a material, such as a cloth or sponge, capable of absorbing ink and thereby preventing ink from scattering. The ink catcher 30 can catch each united ink droplet before it reaches the upper face of the paper 41, and thus any united ink droplet is prevented from reaching the upper face of the paper 41. As illustrated in FIG. 1, a flow passage 31 is provided extending from a bottom portion of the ink catcher 30 for discharging absorbed ink from the ink catcher 30.

Next, a detailed structure of the ink-jet head 10 including the first and second ink ejectors 100 and 200 will be described with reference to FIGS. 2 and 3. In FIG. 3 omitted is illustration of the base portion 11 and the joint portion between the first and second ink ejectors 100 and 200.

Figure 2:
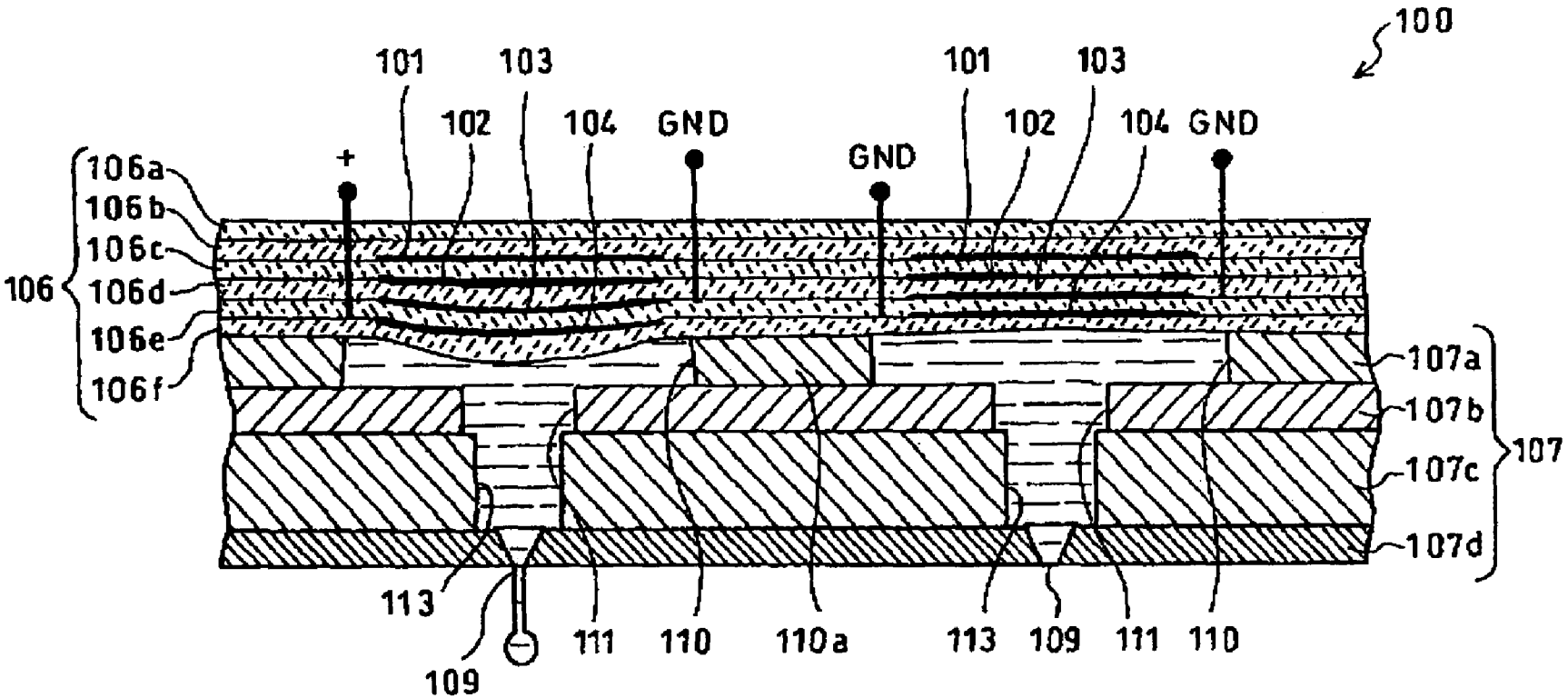
FIG. 2 is a partial sectional view of a first ink ejector in an ink-jet head included in the ink-jet printer of FIG. 1, taken along the length of the first ink ejector.
Figure 3:
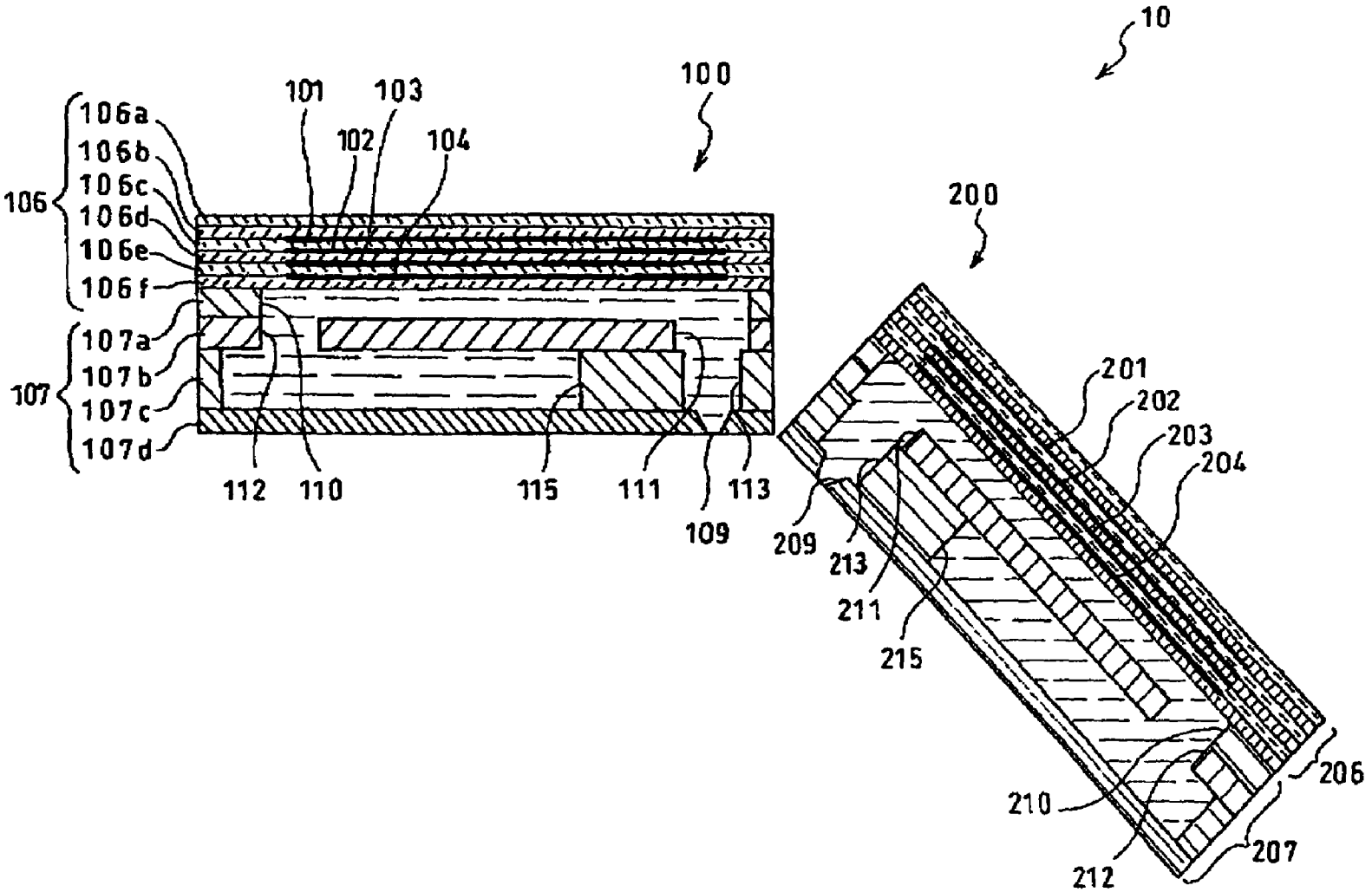
FIG. 3 is a sectional view of the ink-jet head included in the ink-jet printer of FIG. 1, taken along the width of the ink-jet head.

As illustrated in FIGS. 2 and 3, in the first ink ejector 100, an actuator unit 106 and a passage unit 107 are put in layers. The actuator and passage units 106 and 107 are bonded to each other with an epoxy-base thermosetting adhesive. Ink passages are formed in the passage unit 107. The actuator unit 106 is a bimorph-type piezoelectric actuator. The actuator unit 106 is driven with a drive pulse signal, which can take selectively one of the ground potential and a predetermined positive potential, generated in a non-illustrated drive circuit. For applying the drive pulse signal from the non-illustrated drive circuit to the actuator unit 106, a flexible printed wiring board is bonded to the upper face of the actuator unit 106 though the flexible printed wiring board is not illustrated.

The passage unit 107 is made up of three metal plates, i.e., a cavity plate 107*a*, a spacer plate 107*b*, and a manifold plate 107*c*, and a nozzle plate 107*d* made of a synthetic resin, which are put in layers. Nozzles 109 for ejecting ink are formed in the nozzle plate 107*d*. The cavity plate 107*a* in the uppermost layer is in contact with the actuator unit 106.

Pressure chambers 110 are formed in the cavity plate 107*a* for receiving therein ink to be selectively ejected by an action of the actuator unit 106. The pressure chambers 110 are arranged in a row along the length of the ink ejector 100, i.e., in a right-left direction of FIG. 2 and perpendicularly to the drawing sheet of FIG. 3. Partitions 110*a* separate the pressure chambers 110 from each other.

In the spacer plate 107*b* formed are connection holes 111 for connecting one ends of the pressure chambers 110 to the respective nozzles 109 and connection holes 112 (see FIG. 3) for connecting the other ends of the pressure chambers 110 to a manifold channel 115 as will be described later.

In the manifold plate 107*c* formed are connection holes 113 for connecting one ends of the pressure chambers 110 to the respective nozzles 109. In the manifold plate 107*c* further formed is a manifold channel 115 for supplying ink to the pressure chambers 110. The manifold channel 115 is formed under the row of the pressure chambers 110 to extend along the row. One end of the manifold channel 115 is connected to a non-illustrated ink supply source.

Thus, ink passages are formed each extending from the manifold channel 115 through a connection hole 112, a pressure chamber 110, a connection hole 111, and a connection hole 113 to a nozzle 109.

In the actuator unit 106, six piezoelectric ceramic plates 106*a* to 106*f* each made of a ceramic material of lead zirconate titanate (PZT). Common electrodes 101 and 103 are provided between the piezoelectric ceramic plates 106*b* and 106*c* and between the piezoelectric ceramic plates 106*d* and 106*e,* respectively. Each of the common electrodes 101 and 103 is formed only in an area above the corresponding pressure chamber 110 of the passage unit 107. In a modification, large-sized common electrodes 101 and 103 may be used to cover substantially the whole area of each piezoelectric ceramic plate.

Individual electrodes 102 and 104 are provided between the piezoelectric ceramic plates 106*c* and 106*d* and between the piezoelectric ceramic plates 106*e* and 106*f,* respectively. Each of the individual electrodes 102 and 104 is formed only in an area above the corresponding pressure chamber 110 of the passage unit 107.

As illustrated in FIG. 2, the common electrodes 101 and 103 are always kept at the ground potential. On the other hand, a drive pulse signal is applied to individual electrodes 102 and 104 in a pair. Portions of the piezoelectric ceramic plates 106*c* to 106*e* sandwiched by the common electrodes 101 and 103 and the individual electrodes 102 and 104 are active portions having been polarized along the thickness of each piezoelectric ceramic plate by an electric field applied in advance through the electrodes. Therefore, when individual electrodes 102 and 104 in a pair are set at a predetermined positive potential, the corresponding active portions of the piezoelectric ceramic plates 106*c* to 106*e* are going to extend in the thickness of each piezoelectric ceramic plate because of the applied electric field. However, this phenomenon does not occur in the piezoelectric ceramic plates 106*a* and 106*b*. As a result, the portion of the actuator unit 106 corresponding to the active portions swells up into the corresponding pressure chamber 110.

Using the left pressure chamber 110, FIG. 2 illustrates a state wherein the volume of the pressure chamber 110 is decreased by the actuator unit 106 swelled into the pressure chamber 110 because a predetermined positive potential is applied to the corresponding pair of individual electrodes 102 and 104, and thereby ink is ejecting through the nozzle 109 connected to the pressure chamber 110.

A method of "fill before fire" is adopted for ejecting ink. In this method, a voltage is applied in advance to all the individual electrodes 102 and 104 to decrease the volumes of all pressure chambers 110 (as in the left pressure chamber in FIG. 2), the individual electrodes 102 and 104 corresponding to only a pressure chamber 110 to be used for ink ejection are relieved from the voltage to increase the volume of the pressure chamber 110 (as in the right pressure chamber in FIG. 2) so as to generate a negative pressure wave, then a voltage is again applied to the individual electrodes 102 and 104 to decrease the volume of the pressure chamber 110, and thereby ejection pressure is efficiently applied to ink in the pressure chamber 110. A positive pressure wave generated by the application of the voltage is superimposed on the negative pressure wave at the timing when the negative pressure wave is reversed to positive. With this structure, through the nozzle 109, a main droplet and then a satellite droplet smaller in volume are ejected in accordance with one ink ejection signal, that is a drive pulse corresponding to one dot on the paper 41.

The second ink ejector 200 has the same structure as the first ink ejector 100. The second ink ejector 200 operates like the first ink ejector 100 except that the second ink ejector 200 is controlled so as to eject no satellite droplet. For this reason, in FIG. 3, each part of the second ink ejector 200 is denoted by a reference numeral in which only the top figure of the reference numeral denoting the corresponding part of the first ink ejector 100 has been changed from one to two. Thereby, the detailed description of the structure of the second ink ejector 200 is omitted here.

Next, details of ink ejection operation of the ink-jet printer 1 of this embodiment will be described with reference to FIGS. 4A to 4D. In each of FIGS. 4A to 4D omitted is illustration of the portion of the passage unit other than the vicinities of nozzles, and the actuator unit.

Figure 4A:
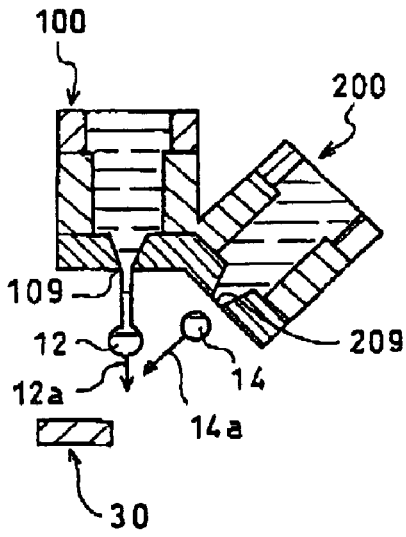
FIGS. 4A to 4D are sectional views each corresponding to FIG. 3, illustrating states of ink droplets ejected from the ink-jet head in the order of time elapsing.

First, as illustrated in FIG. 4A, an ink ejection signal as described above is applied to the actuator unit 106 of the first ink ejector 100 under the control of the controller 20 to eject a main droplet 12 at an ejection speed of about 5 to 15 m/sec through a nozzle 109 of the first ink ejector 100. In FIG. 4A, the main droplet 12 is connected at its rear end to the nozzle 109 and a satellite droplet is not yet formed. On the other hand, an ink ejection signal as described above is applied to the actuator unit 206 of the second ink ejector 200 under the control of the controller 20 to eject an ink droplet 14 at an ejection speed of about 4 m/sec through a nozzle 209 of the second ink ejector 200.

The timings for applying the respective ink ejection signals to the first and second ink ejectors 100 and 200 and the respective ejection speeds of the main and ink droplets 12 and 14 are determined so that the main droplet 12 ejected from the first ink ejector 100 and the ink droplet 14 ejected from the second ink ejector 200 can collide with each other to be united and the united ink droplet flies in a straight line different from the trajectory of the main droplet 12. In this case, the ejection of the main droplet 12 from the first ink ejector 100 and the ejection of the ink droplet 14 from the second ink ejector 200 may or may not be coincide with each other.

The trajectory 12*a* of the main droplet 12, as well as the trajectory 13*a* of a satellite droplet 13 as will be described later, is a straight line perpendicular to the paper 41. The trajectory 14*a* of the ink droplet 14 is a straight line intersecting the trajectory 12*a* of the main droplet 12 at a position obliquely upward from the ink catcher 30.

Figure 4B:
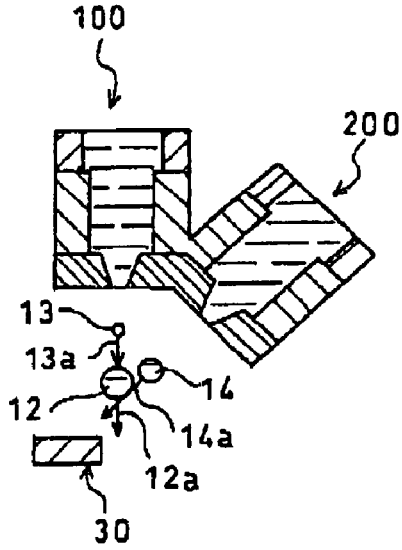

As illustrated in FIG. 4B, immediately after the ejection of the main droplet 12, a satellite droplet 13 is formed by being separated from the main droplet 12 during flying. The main and satellite droplets 12 and 13 fly in their trajectories 12*a* and 13*a* perpendicular to the paper 41.

Figure 4C:
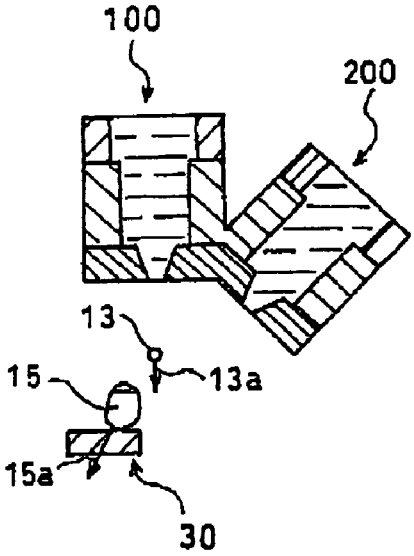

Afterward, the main droplet 12 ejected from the first ink ejector 100 and the ink droplet 14 ejected from the second ink ejector 200 collide with each other. Thereby, as illustrated in FIG. 4C, the main and ink droplets 12 and 14 are united with each other to form a united ink droplet 15. A trajectory 15*a* of the united ink droplet 15, which is determined in accordance with a vector sum of kinetic momentum, that is the product of volume (mass) and velocity, of the two droplets 12 and 14, is a composite trajectory of the trajectories of the two droplets 12 and 14. This trajectory of the united ink droplet 15 is a straight line different from the trajectory 12*a* of the main droplet 12 and extending toward the ink catcher 30. On the other hand, because the satellite droplet 13 is not influenced by the ink droplet 14, it still flies in its trajectory 13*a* with no change.

Figure 4D:
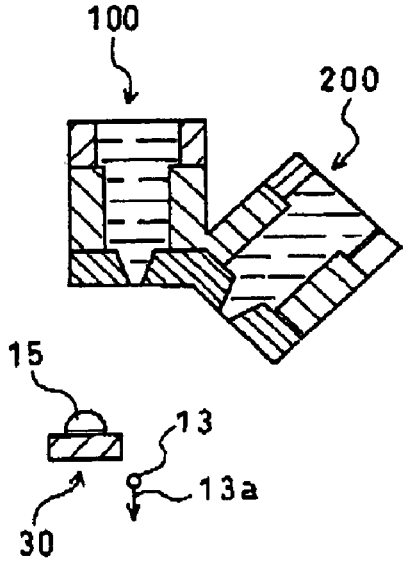

Afterward, as illustrated in FIG. 4D, the united ink droplet 15 is caught by the ink catcher 30 before it reaches the paper 41. The united ink droplet 15 is then discharged from the ink catcher 30 through the ink passage 31 (see FIG. 1). On the other hand, the satellite droplet 13 still flies and soon reaches the paper 41.

Figure 5A:
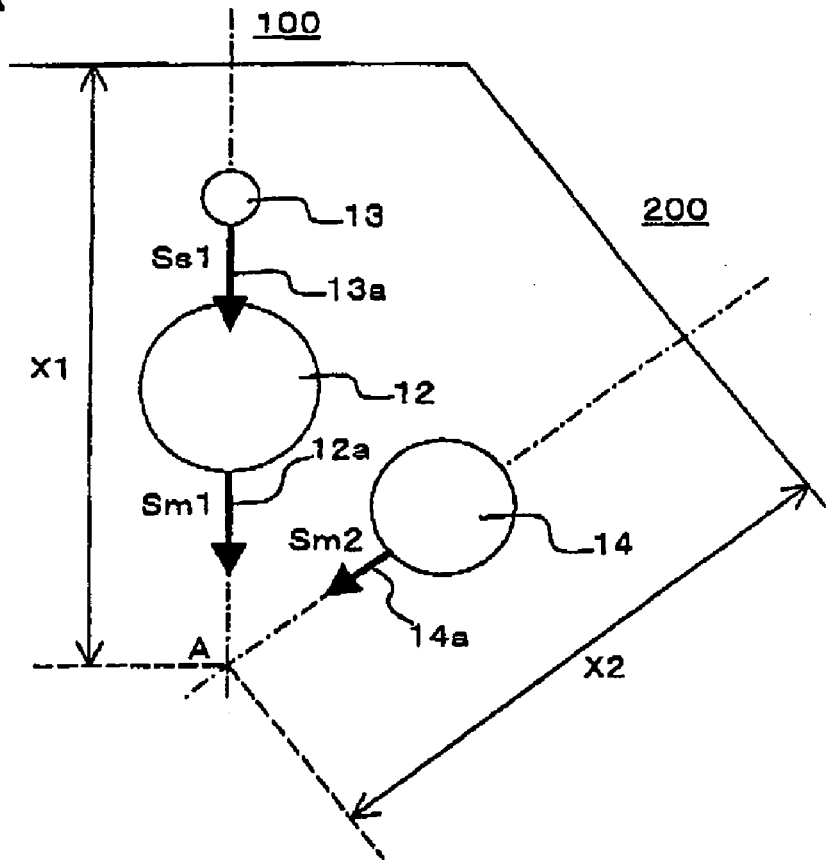
FIG. 5A is an explanatory diagram for explaining relational expressions for each droplet in case that an ejection timing of a second ink ejector is earlier than an ejection timing of the first ink ejector.
Figure 5B:
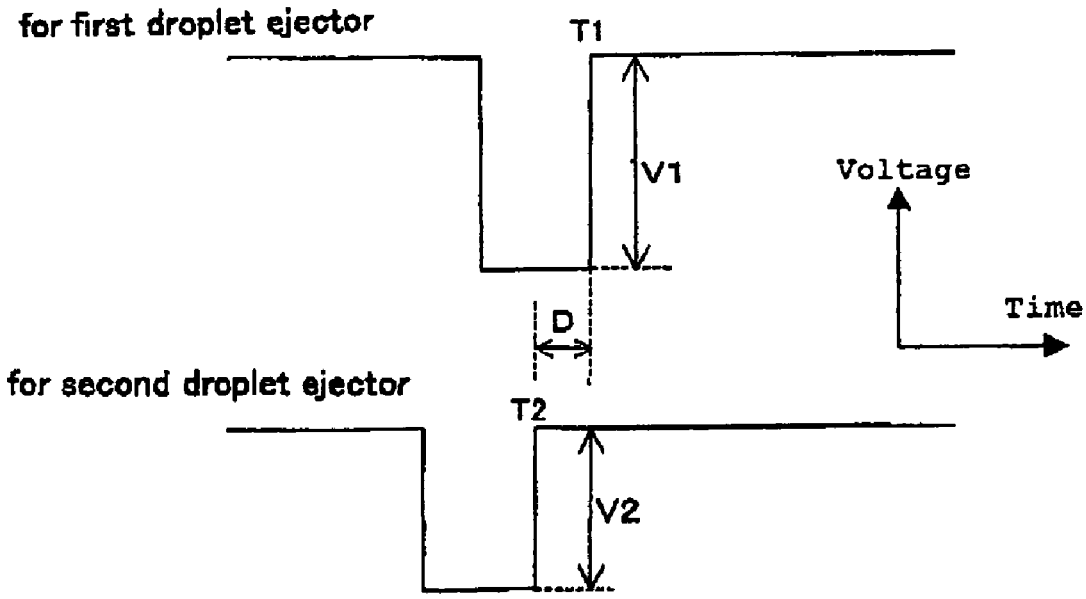
FIG. 5B is a diagrammatic chart of drive pulses applied to the first and the second ink ejectors.

Here will be described, with reference to FIGS. 5A and 5B, relational expressions for each droplet 12, 13, and 14 in case that an ejection timing of the second ink ejector 200 is earlier than an ejection timing of the first ink ejector 100. FIG. 5A shows a state where the droplets 12, 13, and 14 are flying after having been ejected from each of the ink ejectors 100 and 200. FIG. 5B is a diagrammatic chart of drive pulses applied to the first and the second ink ejectors 100 and 200.

When a time elapsed from an ejection of the main droplet 12 until the main droplet 12 reaches a crossing point A (see FIG. 5A) of the trajectory 12*a* of the main droplet 12 and the trajectory 14*a* of the ink droplet 14 is defined as Tm1, the following expression (1) is given.

$$Tm1=X1/Sm1 \quad (1),$$

where X1 represents a distance between the first ink ejector 100 and the crossing point A, and Sm1 represents the ejection speed of the main droplet 12.

Similarly, when a time elapsed from an ejection of the ink droplet 14 until the ink droplet 14 reaches the crossing point A and a time elapsed from an ejection of the satellite droplet 13 until the satellite droplet 13 reaches the crossing point A are defined as Tm2 and Ts1, respectively, the following expressions (2) and (3) are given.

$$Tm2=X2/Sm2 \quad (2)$$

$$Ts1=X1/Ss1 \quad (3),$$

where X2 represents a distance between the second ink ejector 200 and the crossing point A, Sm2 represents the ejection speed of the ink droplet 14, and Ss1 represents the ejection speed of the satellite droplet 13.

As shown in FIG. 5B, moreover, the ejection timing T2 of the second ink ejector 200 and the ejection timing T1 of the first ink ejector 100 have a time difference of D. Further, when drive voltages of the first and second ink ejectors 100 and 200 are defined as V1 and V2, respectively, the expression of V1>V2 is satisfied.

In case that the main droplet 12 and the ink droplet 14 collide with each other, the following expression (4) is satisfied, and when the satellite droplet 13 and the ink droplet 14 do not collide with each other, the following expression (5) is satisfied. However, the left side and the right side of the expression (4) are not needed to be equal with high accuracy, and they may be generally equal to such a degree that the main droplet 12 and the ink droplet 14 can, at least, contact with each other.

$$Tm1+D=Tm2 \quad (4)$$

$$Ts1+D\neq Tm2 \quad (5)$$

By way of example, a case will here be discussed in which X1=1.5 mm; X2=1.5 mm; Sm1=9 m/sec and Ss1=5.5 m/sec with V1=24 V; Sm2=5 m/sec with V2=16 V; and D=143 μsec. In this case, according to the expression (2), the ink droplet 14 from the second ink ejector 200 reaches to the crossing point A when a time period of 300 μsec (Tm2) elapsed since ejection. According to the expression (1), on the other hand, the main droplet 12 from the first ink ejector 100 is ejected after a time period of 143 μsec (D) since the ejection of the ink droplet 14. The main droplet 12 reaches to the crossing point A after a further time period of 167 μsec (Tm1) since the ejection of the main droplet 12, that is, after a time period of 300 μsec (Tm1+D) since the ejection of the ink droplet 14. At this time, the expression (4) is satisfied, and the main droplet 12 and the ink droplet 14 collide with each other. According to the expression (3), moreover, the satellite droplet 13 is ejected after a time period of 143 μsec (D) since the ejection of the ink droplet 14. The satellite droplet 13 reaches to the crossing point A after a further time period of 273 μsec (Ts1) since the ejection of the satellite droplet 13, that is, after a time period of 416 μsec (Ts1+D) since the ejection of the ink droplet 14. At this time, the expression (5) is satisfied, and the satellite droplet 13 and the ink droplet 14 do not collide with each other.

A pulse width of the drive pulses as shown in FIG. 5B is usually set to be equal to a value of AL (Acoustic Length) that is a time length required for a pressure wave to propagate from the manifold channels 115 and 215 toward the nozzles 109 and 209 shown in FIG. 3. The value of this AL is determined in accordance with designs of heads and, for example, is 4 to 12 μsec. When the pulse width is set to be equal to the value of AL, an ejection energy efficiency becomes maximum, and when the pulse width is set to be away from the value of AL, an ejection speed is lowered.

The ejection speeds of droplets ejected from the first and second ejectors 100 and 200 may also be varied in accordance with crest values of the drive voltages V1 and V2, as shown in FIG. 5B, to regulate the time Tm1, Tm2, and Ts1 elapsed until the ejected droplets reach the crossing point A.

FIGS. 4A to 4D and FIG. 5A show movement of each droplet 12, 13, and 14 relative to the ink-jet head 10 including the ink ejectors 100 and 200.

As described above, in the ink-jet printer 1 of this embodiment, the main droplet 12 ejected from the first ink ejector 100 and the ink droplet 14 ejected from the second ink ejector 200 collide with each other to be united and the united ink droplet 15 flies in its trajectory 15*a* different from the trajectory 12*a* of the main droplet 12. As a result, only the satellite droplet 13 ejected from the first ink ejector 100 can reach the paper 41 as a print medium. Thus, printing at a high resolution can be performed using only such very small satellite droplets 13 each having a volume of 0.002 to 0.5 pl.

Because the ink catcher 30 catches the united ink droplet 15 at a position above the upper face of the paper 41, the united ink droplet 15 does not reach the upper face of the paper 41. Thus, the united ink droplet 15 is prevented from soiling the printed face of the paper 41 and therefore the image quality is kept good.

Because the second ink ejector 200 ejects no small-volume droplet other than the ink droplet 14 in accordance with one ink ejection signal, the satellite droplet 13 ejected from the first ink ejector 100 never collides with such a small-volume droplet. Therefore, the first and second ink ejectors 100 and 200 can be easily controlled.

Because both the first and second ink ejectors 100 and 200 are fixed to the frame 43, the first and second ink ejectors 100 and 200 are unlikely to cause errors in the trajectories 12*a* and 14*a* of the droplets 12 and 14 ejected therefrom. As a result, the ink droplet 14 ejected from the second ink ejector 200 can surely collide with the main droplet 12 ejected from the first ink ejector 100.

Because the first and second ink ejectors 100 and 200 are united with each other in a single ink-jet head 10, the ink-jet printer 1 can be very compact.

Although the first and second ink ejectors 100 and 200 are united with each other in a single ink-jet head 10 in the above-described embodiment, the first and second ink ejectors 100 and 200 may be provided as separate ink-jet heads, respectively, in a modification.

An angle formed by the ink ejection faces of two ink ejectors 100 and 200 and an angle formed by the ink ejection face of the second ink ejector 200 and the paper 41 are not limited to 135 degrees and 45 degrees, respectively, and various angles may be acceptable.

Moreover, distances X1 and X2 between each ink ejector 100, 200 and the crossing point A, as shown in FIG. 5A, may properly be changed.

Further, ink to be ejected from the second ink ejector 200 may be made of the same material as or a different material from ink to be ejected from the first ink ejector 100.

Further, the structure of each of the first and second ink ejectors 100 and 200 is not limited to the above-described one. The structure can be variously changed in accordance with, e.g., the application.

Figure 6A:
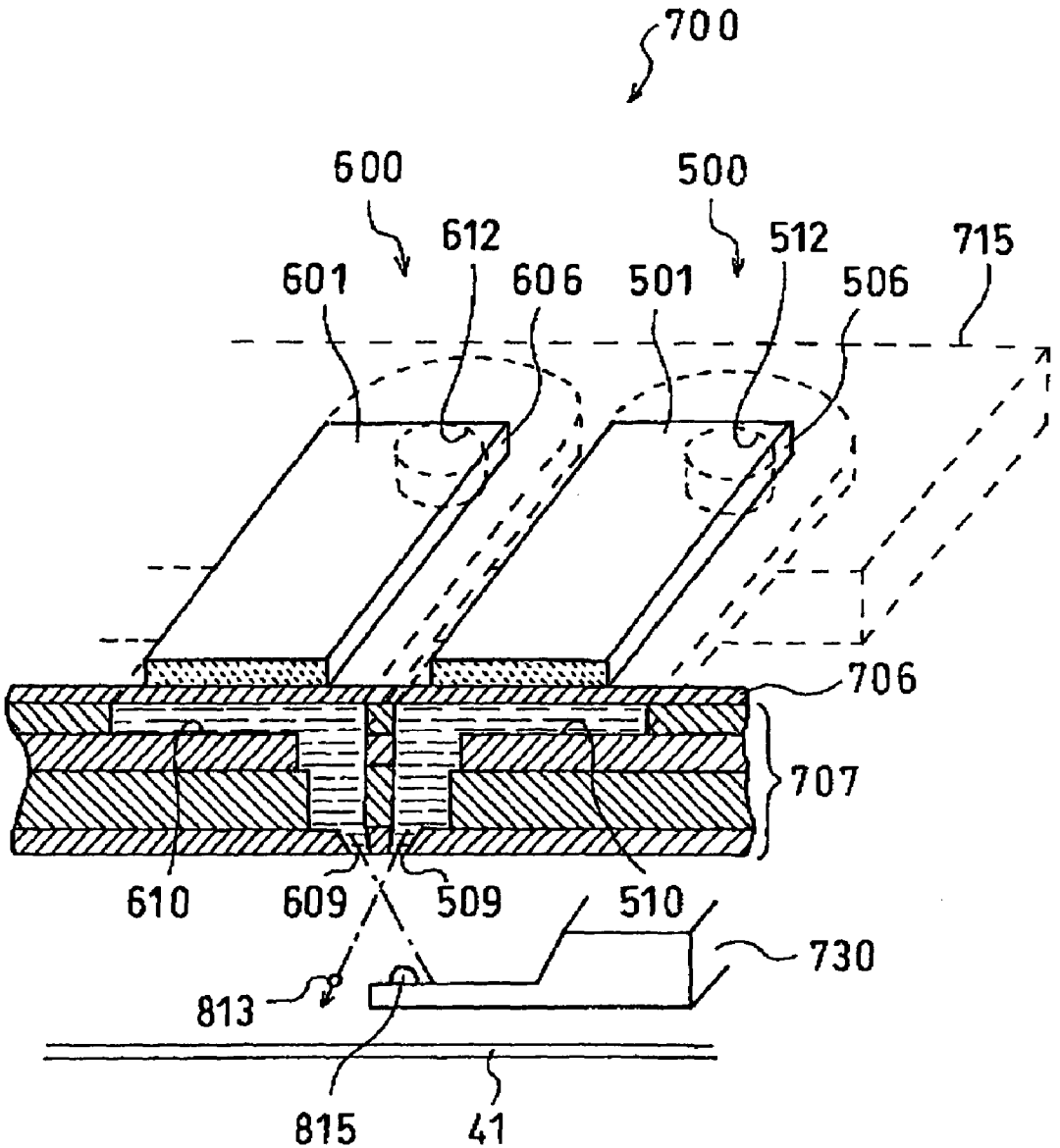
FIG. 6A is a perspective partial sectional view of a modification of the ink-jet head.
Figure 6B:
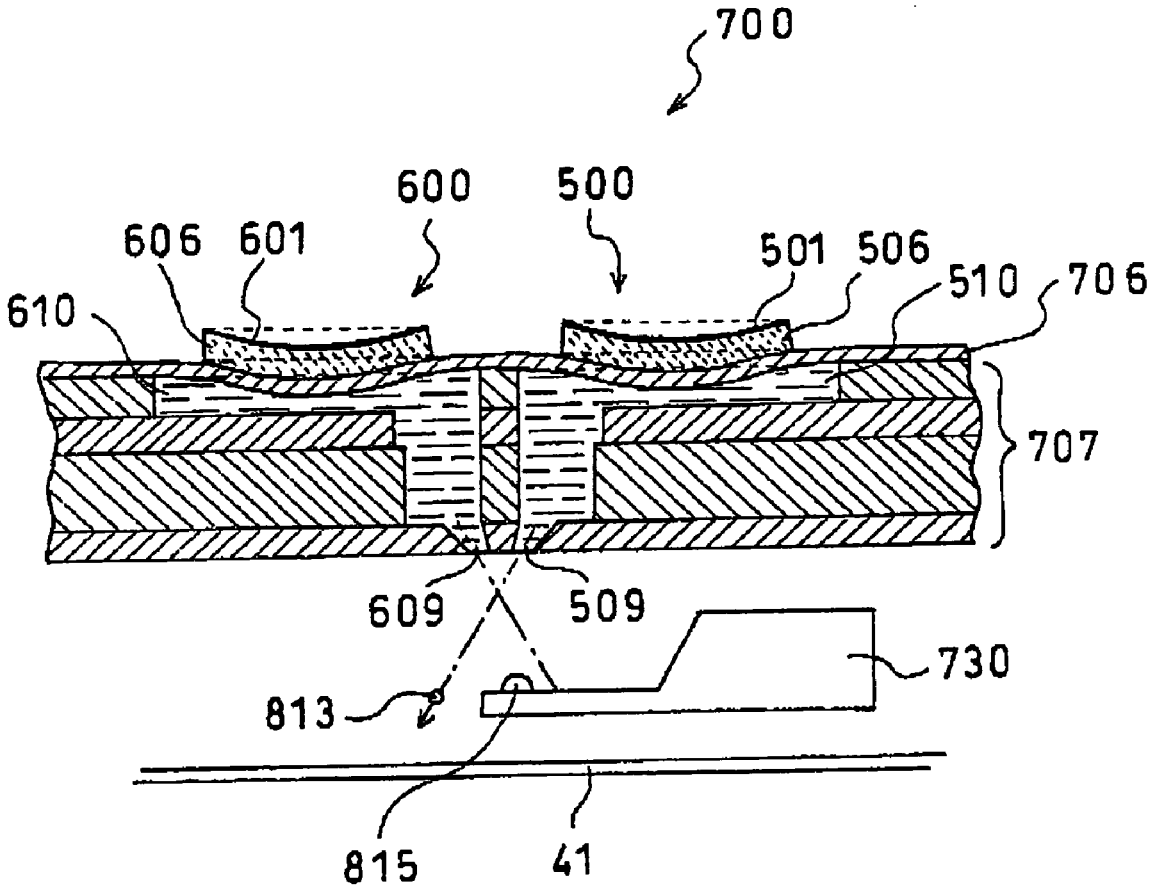
FIG. 6B is a partial enlarged view of FIG. 6A.

For example, an ink-jet head 700 shown in FIGS. 6A and 6B may be mentioned as a modification of the above-described ink-jet head 10. In the ink-jet head 700, provided are a pair of a first ink ejector 500 and a second ink ejector 600 in which axes (illustrated with an alternate long and short dash line in FIG. 6A) of nozzles 509 and 609 intersect with each other. The nozzles 509 and 609 are formed in a nozzle plate constituting a lowermost layer of a passage unit 707, in such a manner as to slope toward each other. A metallic diaphragm 706 is disposed on an uppermost plate formed with pressure chambers 510 and 610. Piezoelectric sheets 506 and 606 polarized in their thickness are disposed on areas of the diaphragm 706 corresponding to each of the pressure chambers 510 and 610, respectively. When the diaphragm 706 is kept at the ground potential, and a potential higher than the ground potential is applied to individual electrodes 501 and 601 on the piezoelectric sheets 506 and 606, the piezoelectric sheets 506 and 606 expand in their thickness direction, and at the same time, contract in their plane direction by a transversal piezoelectric effect. This condition is enlargedly illustrated in FIG. 6B. FIG. 6B shows that the individual electrodes 501 and 601 and the diaphragm 706 are swells up into the pressure chambers 510 and 610 (a unimorph deformation). That is, a drive mechanism of unimorph type is realized.

Moreover, FIG. 6A illustrates with dotted lines communication holes 512 and 612 provided at the other end of each pressure chamber 510, 610, and a manifold channel 715 communicating through the communication holes 512 and 612 with each pressure chamber 510, 610.

Further, as shown in FIGS. 6A and 6B, an ink catcher 730 is disposed between the nozzles 509, 609 and a paper 41. Therefore, a main droplet and a satellite droplet are ejected from the nozzle 509 and only a single ink droplet is ejected from the nozzle 609, and then, similarly to the above-described embodiment, the main droplet from the nozzle 509 and the ink droplet from the nozzle 609 are collide and unite with each other to form a united ink droplet 815, which is then caught by the ink catcher 730. Only the satellite droplet 813 from the nozzle 509 reaches the paper 41.

An actuator is not limited to bimorph structure or unimorph structure, and may have various structures.

Further, the second ink ejector 200 may eject not only the ink droplet 14 but also a satellite droplet that follows the ink droplet 14 and has a volume smaller than the ink droplet 14, in accordance with one ink ejection signal. In this modification, the second ink ejector 200 can eject the ink droplet 14 at a relatively high speed. As a result, the difference of the trajectory of the united ink droplet 15 from the trajectory of the main droplet 12 can be wider. In this modification, however, the small-volume satellite droplet to be ejected from the second ink ejector 200 is desirably controlled so as not to collide with the satellite droplet 13 ejected from the first ink ejector 100. For example, it is preferable to satisfy the following expression (6), in addition to the above-mentioned expressions (4) and (5).

$$Ts1+D \neq Ts2 \quad (6),$$

where Ts2 represents a time taken for the satellite droplet ejected from the second ink ejector 200 to reach the crossing point A in FIG. 5A.

Alternatively, the satellite droplet 13 ejected from the first ink ejector 100 and the satellite droplet ejected from the second ink ejector 200 may be controlled so as to collide with each other to form a print dot on the paper 41. In this case, a trajectory of the united ink droplet of both satellite droplets need to be different from a trajectory of the united ink droplet 15 (see FIG. 4C) of the main droplet 12 and the ink droplet 14, so that the united ink droplet of both satellite droplets can land on the paper 41. The trajectory of the united ink droplet of both satellite droplets is determined in accordance with a vector sum of kinetic momentum, that is the product of volume (mass) and velocity, of two satellite droplets.

For example, in case that the main droplet 12 has a ejection speed of 9 m/sec and a volume of 1 pl, the satellite droplet 13 ejected from the first ink ejector 100 has a ejection speed of 5.5 m/sec and a volume of 0.06 pl, the larger ink droplet 14 (main droplet) ejected from the second ink ejector 200 has a ejection speed of 7 m/sec and a volume of 1 pl, and the satellite droplet 3 ejected from the second ink ejector 200 has a ejection speed of 4.7 m/sec and a volume of 0.06 pl, when D=48 $\mu$sec, the expression Ts1+D=Ts2 is satisfied, thereby obtaining a union of the two larger main droplets, a union of the two smaller satellite droplets, and further, trajectories of these two united droplets different from each other.

Further, the ink-jet head 10 may not be a line type but be a serial type. In this case, the ink-jet head 10 may be controlled so as to reciprocate perpendicularly to the running direction of the paper. Thereby, printing can be performed on a large-sized paper with a short head. When droplets ejected from the ink ejectors 100 and 200 are represented relative to the ink-jet head 10, that is, in a coordinate system with the ink-jet head 10 fixed, FIGS. 4A to 4D and FIG. 5A can also be applied to this case, and the main droplet 12 and the satellite droplet 13 have the same ejection direction, and therefore, have the same trajectory. However, when viewed from the outside of the head 10, since a trajectory is determined in accordance with a vector sum of a ejection speed and a moving speed of the head, the main droplet 12 and the satellite droplet 13 take the different trajectories.

An apparatus constructed like the ink-jet printer of the above-described embodiment may eject droplets of a conductive paste to print a very fine electric circuit pattern. Further, an apparatus constructed like the inkjet printer of the above-described embodiment may eject droplets of an organic luminescent material to make a high-resolution display device such as an organic electroluminescence display (OELD). Other than these, in applications wherein small dots are formed on a print medium, an apparatus like the ink-jet printer of the above-described embodiment can be used very widely.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An apparatus for ejecting very small droplets to form dots on a print medium, the apparatus comprising:

a first droplet ejector capable of ejecting a main droplet in a first trajectory and a satellite droplet smaller in volume than the main droplet;

a second droplet ejector capable of ejecting a droplet in a second trajectory intersecting the first trajectory; and a control unit for controlling the first and second droplet ejectors so that the main droplet and the droplet ejected from the second droplet ejector collide and unite with each other and a united droplet flies in a trajectory different from the first trajectory of the main droplet, and only the satellite droplet lands on the print medium.

2. The apparatus according to claim 1, wherein the control unit controls ejection timings and ejection speeds of the main droplet, the satellite droplet, and the droplet ejected from the second droplet ejector.

3. The apparatus according to claim 2, wherein the satellite droplet flies, relative to the first droplet ejector, in substantially the same trajectory as the first trajectory.

4. The apparatus according to claim 3, wherein the main droplet and the satellite droplet are ejected at a first ejection timing, and the droplet ejected from the second droplet ejector is ejected at a second ejection timing different from the first ejection timing.

5. The apparatus according to claim 4, wherein the second timing is earlier than the first timing with a time difference of D, and when the main droplet and the droplet ejected from the second droplet ejector collide with each other, a following expression is satisfied:

$$Tm1+D=Tm2$$

where $$Tm1=X1/Sm1, \text{ and } Tm2=X2/Sm2;$$

Tm1: a time elapsed from an ejection of the main droplet until the main droplet reaches a crossing point of the first trajectory and the second trajectory;

Tm2: a time elapsed from an ejection of the droplet ejected from the second droplet ejector until the droplet reaches the crossing point;

X1: a distance between the first droplet ejector and the crossing point;

X2: a distance between the second droplet ejector and the crossing point;

Sm1: an ejection speed of the main droplet; and

Sm2: an ejection speed of the droplet ejected from the second droplet ejector.

6. The apparatus according to claim 5, wherein, when the satellite droplet lands on the print medium without colliding with the droplet ejected from the second droplet ejector, a following expression is satisfied:

$$Ts1+D\neq Tm2$$

where $$Ts1=X1/Ss1;$$

Ts1: a time elapsed from an ejection of the satellite droplet until the satellite droplet reaches the crossing point; and Ss1: an ejection speed of the satellite droplet.

7. The apparatus according to claim 2, wherein the control unit applies first and second drive signals to the first and second droplet ejectors, respectively, so as to cause ejections of the main droplet and the satellite droplet from the first droplet ejector, and an ejection of the droplet from the second droplet ejector.

8. The apparatus according to claim 7, wherein the first drive signal includes one drive pulse, the second drive signal includes one drive pulse, and the drive pulse included in the first drive signal has a crest value higher than the drive pulse included in the second drive signal.

9. The apparatus according to claim 2, wherein ejection speeds of the main droplet and the satellite droplet are each substantially 5 to 15 m/sec, and an ejection speed of the droplet ejected from the second droplet ejector is substantially no more than 5 m/sec.

10. The apparatus according to claim 1, wherein a volume of the satellite droplet is substantially 0.002 to 0.5 pl.

11. The apparatus according to claim 1, further comprising a droplet catcher for catching the united droplet before the united droplet lands on the print medium, the droplet catcher being disposed between the first and second droplet ejectors and the print medium.

12. The apparatus according to claim 11, further comprising a discharge passage through which the united droplet caught by the droplet catcher is discharged.

13. The apparatus according to claim 1, wherein the control unit controls the second droplet ejector so as to eject no additional droplet smaller in volume than the droplet ejected from the second droplet ejector, together with the droplet ejected from the second droplet ejector.

14. The apparatus according to claim 1, wherein the control unit controls the first and second droplet ejectors so that the second droplet ejector ejects an additional droplet smaller in volume than the droplet ejected from the second droplet ejector, together with the droplet ejected from the second droplet ejector, and the additional droplet does not collide with the satellite droplet.

15. The apparatus according to claim 1, wherein both the first and second droplet ejectors are fixedly disposed.

16. The apparatus according to claim 1, wherein a plurality of nozzles are formed in each of the first and second droplet ejectors, and axes of the nozzles in the first and second droplet ejectors form an angle with each other.

17. The apparatus according to claim 16, wherein, one of the axis of the nozzle in the first droplet ejector and the axis of the nozzle in the second droplet ejector is perpendicular to the print medium, and the other is tilted with respect to the print medium.

18. The apparatus according to claim 1, wherein each of the first and second droplet ejectors comprises:

a passage unit formed with a plurality of pressure chambers for containing liquid, and nozzles communicating with the respective pressure chambers, and an actuator for changing pressures in the plurality of pressure chambers.

19. The apparatus according to claim 18, wherein the first and second droplet ejectors are united with each other in a single droplet ejection head.

20. An apparatus for ejecting very small droplets, the apparatus comprising:

a first droplet ejector formed with nozzles whose axes extend in a first direction;

a second droplet ejector formed with nozzles whose axes extend in a second direction intersecting the first direction;

a control unit for applying drive signals to the first and second droplet ejectors to cause ejections of droplets from the first and second droplet ejectors; and a droplet catcher for catching a part of the droplets ejected from the first and second droplet ejectors before the part of the droplets lands on a print medium, the droplet catcher being disposed between the first and second droplet ejectors and the print medium, wherein the control unit controls the first and second droplet ejectors so that the first droplet ejector ejects a main droplet and a satellite droplet smaller in volume than the main droplet, the main droplet and a droplet ejected from the second droplet ejector collide and unite with each other and a united droplet flies toward the droplet catcher, and the satellite droplet lands on the print medium.

* * * * *